US005124222A

United States Patent [19]

Clark et al.

[11] Patent Number: 5,124,222

[45] Date of Patent: Jun. 23, 1992

[54] TONER AND DEVELOPER COMPOSITIONS HAVING CLEANING AND LUBRICATING ADDITIVES

[75] Inventors: Jeffrey L. Clark, Nashua; Albert W. Leclair, Hudson, both of N.H.

[73] Assignee: Nashua Corporation, Nashua, N.H.

[21] Appl. No.: 589,043

[22] Filed: Sep. 27, 1990

[51] Int. Cl.[5] ..... G03G 9/083

[52] U.S. Cl. ..... 430/106.6; 430/110; 430/126

[58] Field of Search ..... 430/110, 904, 111, 106.6, 430/126

[56] References Cited

U.S. PATENT DOCUMENTS

| | | | |
|---|---|---|---|
| 3,925,219 | 12/1975 | Strong | 430/109 |
| 4,299,903 | 11/1981 | AuClair et al. | 430/137 |
| 4,460,672 | 7/1984 | Gruber et al. | 430/110 |
| 4,469,770 | 9/1984 | Nelson | 430/110 |
| 4,490,455 | 12/1984 | Hoffend et al. | 430/110 |
| 4,564,573 | 1/1986 | Morita et al. | 430/109 |
| 4,621,039 | 11/1986 | Ciccarelli et al. | 430/106 |
| 4,670,368 | 6/1987 | Tosaka et al. | 430/106.6 |
| 4,804,609 | 2/1989 | Imanaka et al. | 430/106.6 |
| 4,859,560 | 8/1989 | Nakamura et al. | 430/137 |
| 4,883,736 | 11/1989 | Hoffend et al. | 430/110 |
| 4,894,091 | 1/1990 | Georges et al. | 430/137 |
| 4,894,308 | 1/1990 | Mahabadi et al. | 430/137 |
| 4,904,560 | 2/1990 | Yamashiro et al. | 430/137 |
| 4,921,771 | 5/1990 | Tomono et al. | 430/110 |
| 4,933,251 | 6/1990 | Ichimura et al. | 430/109 |

*Primary Examiner*—John Goodrow

*Attorney, Agent, or Firm*—Testa, Hurwitz & Thibeault

[57] ABSTRACT

Disclosed are toner compositions which comprise a toner particle having cleaning and lubricating agents added externally thereto. The cleaning and lubricating agents improve copy quality and extend the developer lifetime as they are electrically compatible with the toner particles over the duration of the developer lifetime. The external lubricating additive comprises a modified wax component having a relatively small percentage of a charge enhancing additive dissolved in a low molecular weight wax material. Optionally, the external additive may comprise amorphous silica particles and magnetite particles.

13 Claims, No Drawings

TONER AND DEVELOPER COMPOSITIONS HAVING CLEANING AND LUBRICATING ADDITIVES

BACKGROUND OF THE INVENTION

The present invention relates to toner and developer compositions which provide better images and have a longer lifetime. More particularly, the invention relates to toner and developer compositions in which the toner includes an external additive or lubricant which is electrostatically compatible with the toner polymer.

Image recording devices such as printers, copy machines and the like, generally have a photoconductor which must be cleaned of toner residue between copies. A wiping member is often used to clean the photoconductor. Despite the use of wiping members and similar devices to remove toner residue from the photoconductor, some residue may remain and cause scorching of the photoconductor and generally poor quality images.

Various lubricating and cleaning aids are well known in the field of electrophotography to help clean and preserve photoreceptors used in xerographic processes, and to improve the release characteristics of fuser rolls. In some instances, additives such as lubricants are not completely electrically compatible with the toners with which they are used. Thus, such additives can interfere with image development, charge acquisition and charge distribution in electrostatic toners. The presence of an additive within a toner composition having electrical properties which are incompatible with a toner (i.e., a charge opposite the toner) can impair the proper transport of the toner and cause toner to be collected at inappropriate sites. This can result in poor image quality (including unwanted spots, fuzziness and ghost images). Thus, the choice of a proper additive is critical to obtaining quality copies.

It would therefore be desirable to provide toner and developer compositions which include appropriate cleaning aids and lubricants which do not interfere with image development, copy quality or developer lifetime.

Accordingly, one object of the invention is to provide toner and developer compositions having relatively long lifetimes which produce good quality copies. Another object of the invention is to provide developer and toner compositions which include cleaning aids and lubricants which are electrically compatible with the toner polymer. A further object of the invention is to provide a cleaning additive and lubricant which can be incorporated into toner and developer compositions to become electrically compatible with the toner polymer. Additional objects of the invention will be apparent upon review of the disclosure which follows.

SUMMARY OF THE INVENTION

The present invention is directed to toner and developer compositions which include external toner additives which contribute cleaning and lubricating properties to the toner and developer materials. Such additives are advantageous as they do not adversely affect the charge of the toner. That is, they are electrically compatible with the toner.

The present toner composition thus comprises a toner component having a polymeric resin with pigment particles incorporated therein. Optionally, the toner component may also comprise a charge enhancing additive. The external toner additives comprise a modified wax material comprised of a low molecular weight wax having a minor amount of a charge enhancing additive dissolved therein. The external toner additive may optionally include particles of amorphous silica and/or conductive materials. As noted above, the external toner additive should be electrically compatible with the resin particles in that it will not adversely affect the charge of the toner particles. Also, the toner additives should have a melting point not substantially below that of the toner particles.

Typically, the external toner additive is blended with the toner component in a mixer at a concentration of about 0.05 to 10% by weight of the total toner composition. At least part of the toner additive becomes free-flowing within the toner composition and a portion of the additive may adhere to the outer surface of the toner particles, in a discrete, non-uniform pattern.

DETAILED DESCRIPTION OF THE INVENTION

As noted above, the present invention comprises a toner composition which includes a toner component and an external cleaning and lubricating additive. The external additive provides typical cleaning and lubricating functions and consequently protects image recording device components, such as photoconductors and carriers, from damage due to impaction and sticking by toners. Consequently the cleaning and lubricating additive acts to substantially prolong the useful lifetime of toner and developer compositions. While many types of toner cleaning and lubricating aids are known, they are not always completely electrically compatible with the toner compositions. The present cleaning and lubricating aid can be engineered to be compatible with the electrical properties of various toners. For example, unfunctionalized hydrocarbon waxes are generally negative in charge, however, by the incorporation of the appropriate charge enhancing additives they can be made to charge anywhere from being slightly less negative, to positive.

The toner component of the present invention comprises polymeric resin particles and pigment particles. The toner component may also include other additives such as charge enhancing additives and other property enhancing additives. The manner of combining these components to form finely divided toner particles having sizes in the range of approximately 5 to 30 microns is well known in the art. Virtually any toner may be used in connection with the present invention. Moreover, the toner component which may used in the present invention includes both mono component and two component toners, as well as toners having colored pigments or black pigments able to render both colored and black-and-white images.

The external additive of this invention preferably comprises a blend of a modified wax component or other modified wax-like materials such as polymer or hydrocarbon-based low surface energy materials, and/or a flow aid such as silica. In other embodiments the additive may also include conductive materials such as metallic oxides or carbon black as well. Alternatively, the additive may include only the modified wax. The modified wax or wax-like material comprises a minor amount of a charge enhancing additive dissolved in a predominant amount of a molten wax material. This mixture is solidified by cooling and is subsequently jet pulverized to yield to a particle size that is substantially within the range of 0.1 to 25 microns. After the external additive is formed (e.g., by combining desired components such as modified wax, silica and conductive particles) it is blended with the toner component, preferably under high shear conditions, to yield the toner composition of the invention.

This toner composition takes the form of toner component particles combined with a free-flowing external toner additive. Some portion of the external additive may not be free-flowing, but instead may be adhered to the toner particles in a discrete, non-uniform pattern.

The polymeric resin which may be used with the toner component includes all of those which are well known in the art. Generally, the polymeric resin comprises from about 50 to about 95% by weight of the toner composition. Exemplary polymers include polyesters, polyamides, epoxy resins, polyurethanes, polyolefins, vinyl resins and polymeric esterification products of a dicarboxylic acid and a diol comprising a diphenol. Exemplary vinyl resins may be either homopolymers or copolymers. Suitable vinyl homopolymers include polystyrene, polychlorostyrene, vinyl naphthalene, unsaturated mono olefins such as ethylene, propylene, butylene, isobutylene, and the like; polyvinyl halides such as polyvinyl chloride, polyvinylbromide, polyvinylfluoride, polyvinyl acetate, polyvinyl propionate, polyvinyl benzoate and polyvinyl butylate; vinyl esters such as esters of monocarboxylic acids including polymethyl acrylate, polyethyl acrylate, polybutyl acrylate, polyisobutyl acrylate, polydodecyl acrylate, polyoctyl acrylate, poly-2-chloroethyl acrylate, polyphenyl acrylate and others; vinyl ethers such as polyvinyl methylether, polyvinyl isobutyl ether and polyvinyl ethyl ether; N-vinyl indole; and vinyl pyrrolidone; polystyrene butadiene copolymers prepared by both emulsion and suspension polymerization. A presently preferred polymeric resin is a styrene butadiene copolymer which may be prepared by a suspension polymerization Process. Such a styrene butadiene copolymer comprises from about 80 to 95% styrene component and from 5 to 20% butadiene component. Most preferably, the styrene butadiene copolymer contains the 91% styrene component and about 9% butadiene component. A method of preparing a suitable styrene butadiene toner polymer by suspension polymerization is described in a copending U.S. application of Mahmud, filed Sep. 27, 1990, entitled "Suspension Polymerization Process for Styrenic Toner Copolymers", the disclosure of which is incorporated herein by reference.

A variety of well known pigments are generally combined with the polymeric resins in order to enable the toner composition to have a color sufficient to permit the formation of visible images. Exemplary pigment materials include carbon black, nigrosine dye, aniline blue, phthalocyanine derivatives, magnetites and mixtures thereof. Other organic and organo metallic dyes which are well known in the art may be used as the pigment as well. Preferably the pigment component comprises approximately 3 to 60% by weight of the toner composition. Preferred pigment materials include carbon black (such as "Regal 330" available from Cabot Corporation and a combination of carbon black and magnetites. Suitable combinations of carbon black and magnetites include pigment components having approximately 3 to about 18% by weight of carbon black and about 82 to about 97% by weight of magnetites. One preferred magnetite compound is commercially available as "Mapico Black" from Columbian Chemical Company.

Charge enhancing additives, many of which are well known in the art, may be incorporated into the toner component of the present invention to increase or decrease the total charge obtained, as well as to increase the admix charge rate. Preferably these charge enhancing additives are added at a concentration ranging between a 0.1 and 5% by weight of the toner composition. A variety of charge enhancing additives are well known in the art and may be used in preparing the toner component of the invention. Exemplary charge enhancing additives include positive charging compounds including alkyl pyridinium halides such as cetyl pyridinium chloride, cetyl pyridinium tetrafluorides; quaternary ammonium salts; quaternary ammonium sulfates; and sulfonate compounds. Negative charging additives may be used as well, and such charge enhancing additives include dioctyl sodium sulfosuccinate; PC-100, available from DuPont; FCA 201 Pb, FCA 201 Pz, FCA 1001 NB and FCA 1001 NZ, available from Polytribo, Inc. Most preferably, these agents are added to the toner component in a concentration of between 0.5 and 3% by weight.

The wax or wax-like component of the external toner additive generally is a low molecular weight waxy material having a molecular weight in the range of about 250 to 30,000. Alternatively, the wax-like material may be an oligomer or a fatty acid salt. Exemplary waxy substances which may be used with this invention include branched or linear polyolefin waxes, such as polyethylene waxes, polypropylene waxes and mixtures thereof. Wax-like materials may include halogenated oligomers and polymers, fatty acids, and metal salts of fatty acids including (e.g., zinc stearate, magnesium stearate and aluminum stearate). A currently preferred wax material is a linear polyethylene wax having a molecular weight of about 700, commercially available as "Polywax 655" from Petrolite Corporation. The modified wax component of the external additive also comprises one or a mixture of charge enhancing additives. Virtually any of the charge enhancing additives which are well known in the art, and which are identified above, may be used in combination with the waxy or wax-like material to form part of the external additive. However, one requirement of the charge enhancing additive is that it be soluble or dispersible in the molten wax or wax-like material. The charge enhancing additive should be capable of modifying the charge of the wax or wax-like material in a desired manner. That is, where a positive toner is used, and the wax or wax-like material is negatively charged, the charge enhancing additive should either render the wax or wax-like material to a positive charge, or reduce the negativity of the charge. In addition, the wax component should have a softening range which is not substantially below that of the toner material. Preferably the softening range should be above about 45° C.

The charge enhancing additive which is incorporated into the toner component may also used as the charge enhancing additive which is dissolved or dispersed in the molten wax or wax-like material to form the modified wax component of the external additive. Of course, it is also possible to use a charge enhancing additive in the external additive which is different from that used in the toner component.

Preferably, the wax component comprises from about 0.05 to 5% charge enhancing additive, dissolved or dispersed in approximately 95 to 99.5% molten wax or wax-like material. After solubilizing and dispersing the charge enhancing additive within the molten wax, the mixture is solidified by cooling, and is reduced so as to have a particle size in the range 0.1 to 25 microns by techniques such as jet pulverization. Approximately 0.05 to 5% of the modified wax component, by weight of the total toner composition, is combined with the toner component.

In addition to the modified wax component, the external toner additive also includes a flow aid lubricant such as amorphous silica, alumina or carbon black. A preferred flow aid is a silica material sold as Aerosil R972 by Degussa Corporation. In preferred embodiments this component is added to the toner component at a concentration ranging from 0.05 and 0.3% by weight of the total toner composition. The particle size of such additives is in the range of about 0.1–0.4 microns.

The external toner additives may optionally include finely divided conductive particles having a particle size ranging between 0.1 and 0.4 micron. Exemplary conductive particles include magnetites, ferrites, metallic oxides and carbon black. A preferred conductive particle is a magnetite, one example of which is Mapico Black, available from Columbian Chemical Company. Preferably the conductive particles are added to the toner component at a concentration ranging from about 0.6 to about 5% by weight of the total toner composition. A more preferred concentration is 0.75 to 1.5 percent.

The toner composition of the present invention is obtained by first preparing or selecting a desired toner component (i.e., polymeric resin particles combined with pigment and other desired internal additives). Next, the appropriate charge enhancing additive for use as part of the external additive for the desired toner is selected. It is preferable, but not necessary, that the charge enhancing additive used in the external additive be the same as that internally incorporated within the toner particles. The type of charge enhancing additive to be used with the external additive of the present invention depends to a large extent on the electrical properties of the toner material. For example, a charge enhancing additive having a positive polarity can be used with a negatively charged wax or wax-like material and a positively charged toner. This will render the charge of the wax material positive, or reduce its negativity, thus making the additive more compatible with the toner. Likewise, a charge enhancing additive with a negative polarity can be used to reduce the inherent negative charge of a waxy material to become more compatible in a negatively charge toner. Another requirement of a charge enhancing additive is that it be soluble or dispersible in molten wax.

After selecting the proper charge enhancing additive, approximately two parts of the charge enhancing additive are dissolved or dispersed into approximately 98 parts of molten wax. This mixture is solidified by cooling, then is jet pulverized to yield finely divided particles having a size of about 2 to 30 microns, roughly equivalent in size to the toner particles themselves.

The toner composition is prepared by combining the toner component and then the desired external additives. That is, approximately 0.05 to 0.5% silica by weight of total toner composition, approximately 0.05 to 10% of the modified wax component, and, optionally, about 0.6 to 2% magnetite is added to a Henschel mixer. Next the mixer is charged with the appropriate amount of toner components. This combination is blended in the mixer for about 2 to 3 minutes while cooling to a temperature of about 18° C. to yield the toner composition for use with the present invention.

Suitable carrier materials which can be employed in formulating a developer composition include materials, known to those having ordinary skill in the art, capable of triboelectrically obtaining a charge of opposite polarity to that of a toner composition. That is, where positively charged toner particles are used, the carriers should be charged to a negative polarity so that the toner particle will adhere to and surround the carrier particles. Exemplary carrier materials include coated or uncoated particles of glass, steel, nickel, iron, ferrites, iron oxides, silicon dioxides, and the like. A preferred carrier for use with a positively charged toner component is iron powder coated with polyvinylidene fluoride The invention is more fully described by reference to the following examples

EXAMPLE 1

The modified wax external additive was prepared by melting 98 parts of Petrolite Polywax 655 together with 2 parts of distearyl dimethyl ammonium chloride charge enhancing additive (arosurf TA101). After melting and appropriate blending, this mixture was allowed to solidify. Subsequently the solidified mixture was jet pulverized to an average particle size of about 8.5 microns. Approximately 0.3% of this modified wax external additive, together with 0.15% amorphous silica and 0.75% magnetite, was added to a styrene butadiene-based toner component prepared by melt blending, followed by mechanical attrition. The styrene butadiene-based toner component comprised 80% by weight of a styrene butadiene polymer (having 91% styrene and 9% by weight butadiene), 3% by weight of carbon black (Regal 330) 16% by weight of magnetite (Mapico Black), and 1% by weight of distearyl dimethyl ammonium chloride charge enhancing additive (Arosurf TA101). The toner composition thus prepared and having the modified wax external additive was combined with polyvinylidene fluoride-coated iron carrier particles to yield a developer. This developer was used in a copy machine employing a belt-type photoconductor having a wiping member for cleaning the photoconductor. Over 200,000 copies were made without any noticeable deterioration in developer charge as measured by the Faraday Cage blow-off method. In addition, the copies were sharp and well-defined at the edges of the images.

EXAMPLE 2

A modified wax external additive was prepared by combining and melting together 99 parts of Petrolite Polywax 655 and 1 part distearyl dimethyl ammonium chloride charge enhancing additive (Arosurf TA101). Following cooling this mixture solidified and was jet pulverized to an average particle size of about 8.5 microns. Approximately 0.3% by weight of this external additive, together with 0.15% amorphous silica, was added to a styrene butadiene-based toner component. This styrene butadiene toner component was the same as that described in Example 1. A developer was prepared by mixing polyvinylidene fluoride-coated iron carrier particles and with the toner composition described above. It was discovered that the developer life was improved using this external additive, as copy quality was superior with dark, solid images and excellent edge definition.

EXAMPLE 3

Toner compositions were prepared as described in Examples 1 and 2, except that the external toner additive included silica and magnetite, but only the Petrolite Polywax 655, without the charge enhancing additive. Developer compositions were prepared using these toners and polyvinylidene fluoride-coated iron particles. The developer composition was run in photocopy machines of the type described in Example 1. It was found that the developer charge deteriorated after only about 30,000 copies. Moreover, copy quality was poor as the images were light and fuzzy with poor edge definition.

EXAMPLE 4

Toner compositions were prepared as described in Examples 1 and 2, although only silica and magnetite were used in the external toner additive. Developer compositions were prepared by combining these toners with polyvinylidene fluoride-coated iron particles and the developers were used in copy machines of the type described in Example 1. It was found that images produced using these developers were initially of good quality, but the quality of the images deteriorated markedly after about 30,000 copies. It was also found that photoconductor was irreversibly scorched due to the lack of lubricant (e.g., wax) and that the developer charge deteriorated after about 25,000 copies, resulting in copies with fogged background due to poor cleaning of the photoconductor belt.

EXAMPLE 5

A modified wax external additive was prepared as described in Example 1. The wax external additive was added at a concentration of 0.1%, while 0.15% silica and 0.75% magnetite were externally added and combined with the toner component described in Example 1. The developer was prepared by combining this toner composition with polyvinylidene fluoride-coated iron particles, and the developer was utilized in a copy machine of the type described in Example 1. It was discovered that copies made using this developer had excellent image quality for over 100,000 copies with good edge definition and an absence of fogging. The developer charge remained stable for about 100,000 copies but deteriorated thereafter. It was also discovered that there was good cleaning of photoconductor belt with no scorching up to about 100,000 copies.

EXAMPLE 6

A modified wax external additive was prepared by combining and melting together 99 parts or Petrolite Polywax 655 and 1 part Aerosol OT (dioctyl sodium sulfosuccinate) available from American Cyanamid Company. This modified wax material was prepared and ground to a particle size of 8.5 microns. The charge of this material as measured by the Faraday Cage blow off technique (using silicone coated ferrite carrier beads) to be $-12\ \mu C/g$. The same additive, without the Aerosol OT charge enhancing additive, had a charge $-27\ \mu C/g$.

EXAMPLE 7

The effect on charge of Petrolite Polywax 655 by the addition of various charge enhancing additives was evaluated as follows. The modified wax component of Example 1 had a charge, as measured against the carrier of Example 1, of 9.03 $\mu C/g$. The charge of this wax, without the charge enhancing additive was 0.1 $\mu C/g$. The modified wax component of Example 2 had a charge, as measured against the carrier of Example 2, of 7.94 $\mu C/g$. Again, the charge of the wax without the charge enhancing additive was 0.1 $\mu C/g$.

It is understood that the present invention may be embodied in other forms not specifically described above, without departing from the spirit and scope of the invention.

What is claimed is:

1. A toner, comprising:

a toner component comprising polymeric resin particles having pigment particles incorporated therein; and an external toner additive, constituting about 0.05 to 10% by weight of the toner, said external additive comprising a modified wax or wax-like composition comprising a charge enhancing additive selected from the group consisting of: quaternary ammonium salts, alkyl pyridinium halides, aromatic sulfonates and aromatic sulfates, and a low molecular weight wax or wax-like material;

said composition having a charge of substantially the same polarity as that of the toner component, and having a melting range above about 45° C.

2. The toner of claim 1 wherein the toner component further comprises a charge enhancing additive.

3. The toner of claim 1 wherein the external additive further comprises approximately 0.05 to 0.5% by weight of the toner, of a flow aid selected from the group consisting of amorphous silica and alumina.

4. The toner of claim 3 wherein the external additive further comprises approximately 0.6 to 2.0% by weight of a conductive material selected from the group consisting of magnetite, ferrite, metallic oxides and carbon black.

5. The toner of claim 1 wherein the pigment particles of the toner component are selected from the group consisting of carbon black, magnetite, and mixtures thereof.

6. The toner of claim 5 wherein the toner component comprises approximately 70–95% of a styrene butadiene copolymer, 3 to 55% of pigment particles and 0.5 to 4% of a charge enhancing additive.

7. The composition of claim 6 wherein the toner comprises the toner component and about 0.05 to 10% by weight of external additives selected from the group consisting of the modified wax material, amorphous silica, magnetite, and mixtures thereof.

8. The toner of claim 7 wherein a major portion of the external toner additive is free-flowing within the toner composition.

9. The toner of claim 8 wherein the low molecular weight wax or wax-like composition is selected from the group consisting of polyethylene waxes, linear polypropylene waxes, branched polypropylene waxes, higher polymeric alkene waxes, fluorinated polymers, fatty acids, metal salts of fatty acids and mixtures thereof.

10. The toner of claim 1 wherein the charge enhancing additive is distearyl dimethyl ammonium chloride.

11. A developer comprising the toner composition of claim 1 and carrier particles.

12. The developer of claim 11 wherein the carrier particles are coated or uncoated particles selected from the group consisting of glass, steel, nickel, iron, and ferrite.

13. An imaging method, comprising the steps of:

generating an electrostatic latent image on a photoconductive imaging member;

developing the latent image with the developer composition of claim 12;

transferring the developed image to a permanent substrate; and permanently affixing the image to the substrate.

* * * * *